United States Patent [19]

Spademan

[11] Patent Number: 4,768,792

[45] Date of Patent: Sep. 6, 1988

[54] SKI BINDING TOE PIECE

[76] Inventor: Richard G. Spademan, Box 6410, Incline Village, Nev. 89450

[21] Appl. No.: 87,070

[22] Filed: Aug. 19, 1987

Related U.S. Application Data

[63] Continuation-in-part of Ser. No. 20,157, Feb. 25, 1987, abandoned, which is a continuation of Ser. No. 704,057, May 16, 1985, abandoned, which is a continuation-in-part of Ser. No. 623,322, Jun. 22, 1984, abandoned.

[51] Int. Cl.[4] ..... A63C 9/08

[52] U.S. Cl. ..... 280/632

[58] Field of Search ..... 280/614, 615, 624, 626, 280/631, 632

[56] References Cited

U.S. PATENT DOCUMENTS

| | | | |
|---|---|---|---|
| 3,271,040 | 9/1966 | Spademan | 280/624 |
| 3,494,628 | 2/1970 | Spademan | 280/624 |
| 3,874,684 | 4/1975 | Dysthe | 280/615 |
| 4,004,823 | 1/1977 | Pyzel et al. | 280/615 |
| 4,219,216 | 8/1980 | Settembre | 280/631 X |
| 4,365,821 | 12/1982 | Kreyenbuhl | 280/615 |
| 4,484,764 | 11/1984 | Kirsch | 280/631 X |

FOREIGN PATENT DOCUMENTS

| | | | |
|---|---|---|---|
| 2622966 | 4/1977 | Fed. Rep. of Germany | 280/615 |

*Primary Examiner*—John J. Love
*Assistant Examiner*—Michael Mar
*Attorney, Agent, or Firm*—Townsend and Townsend

[57] ABSTRACT

An alpine ski binding releasable toe piece is provided for holding the toe of a ski boot on a ski that allows for unimpeded forward movement of the ski boot along the ski upon ski binding release. The toe piece comprises an upstanding holding member hinged to a baseplate for engaging the toe of a ski boot, a spring member to pivot the holding member from the inoperative to operative position and a holding member engaging rib that requires that a greater force be applied to the holding member to move the holding member from the operative position to the inoperative position than from the inoperative to operative position.

2 Claims, 2 Drawing Sheets

SKI BINDING TOE PIECE

BACKGROUND OF THE INVENTION

This application is a continuation-in-part of Ser. No. 020,157, filed Feb. 25, 1987 now abandoned which in turn is a continuation of Ser. No. 704,057, filed May 16, 1985, now abandoned which in turn is a continuation-in-part of Ser. No. 623,322 filed June 22, 1984 now abandoned.

The present invention relates to alpine ski bindings and more particularly to a releasable toe piece for holding the toe of a ski boot on a ski that allows for unimpeded forward movement of the ski boot along the ski upon ski binding release. Most toe pieces presently available have an obstruction to movement of the ski boot forwardly along the ski in a release condition.

During most potential injury producing falls, there is forward momentum of the skier's body relative to the ski jamming the toe of the ski boot into the upright obstruction of a conventional toe piece. This jamming causes frictional buildup and momentary entrapment of the ski boot toe in the toe piece. This condition occurs particularly while skiing the more recent parallel skiing technique when there is a relative upright body position with flexed ankles and knees. Longer skiis and advanced slope grooming technique that allow faster skiing compounds this condition.

In an impending fall condition with relative forward momentum of the skier's body, the ankle can become acutely dorsiflexed and the knee fully extended. With the range of motion severely reduced, the ankle and knee become rigid levers. As a result of the anatomical configuration of the ankle and knee, energy is transferred to the joint supporting structures leading to ligament strain, ligament disruption or bone fracture. The ankle mortise includes downwardly extending medial, posterior and lateral malleoli and their supporting ligaments from the tibia and fibula. The talus fits into this mortise as a tenon and has a monaxial curvature with a forward and rearward convexity. The talus is wider in its forward portion than in its rearward portion. With the skier's ankle flexed, further forward or rotational movement in the joint is severely restricted. Thus a relatively rigid lever member is formed and this lever member is extended to the end of the ski in a forward deceleration fall condition. In this type of fall, there is danger of deceleration damage to the ankle structures in the form of ligamentous injury or malleoli fracture. The energy also can be transmitted to the tibia and fibula with consequent fracture. With modern higher boot construction, this energy is often transmitted to the knee. With the knee in full extension, the medial and lateral collateral ligaments and the posterior capsule are tight. Further extension or rotation can severely compromise these ligamentous structures or tear a meniscus.

Presently available toe pieces fail to compensate for forward impact into the toe piece during a forward deceleration fall or a fall with a rotational component, often causing injury to the ankle, leg or knee. Most toe pieces are designed to allow sideward rotational release at the toe. There is usually a forward component of force and a momentary increase of impact energy and entrapment during a fall. Injury occurs and then the toe of the boot is released by sideward rotation from the binding as this frictional buildup is relieved by the disruption of the rigid lever. This entrapment is further compounded by the flex of modern skiis that jam the boot between the toe piece and heel piece in some fall conditions.

In U.S. Pat. No. 3,494,628, there is disclosed a toe piece construction which will permit unimpeded forward movement of the ski boot along the ski under binding release conditions. However, studies of fall conditions with modern boots and skiis in conjunction with modern ski technique have shown that the embodiments disclosed in this patent are deficient in a number of respects. Firstly, the force necessary to hold the modern rigid and high ski boot stable on the ski results in such a greatly increased force to pivot the upwardly extending member shown in the disclosure forwardly against the ski that the force can exceed the threshold of energy necessary to sustain a lower extremity injury. Secondly any forward or sideward shock loading of the binding moves the ski boot toe and thus pivots the upwardly extending holding member to a slightly forward pivoted position where the boot can readily release upwardly at the toe causing a potential injury producing condition referred to as prerelease. This movement also readily occurs with the more recent soft flex skiis in combination with rigid ski boot soles when skiing between moguls. The higher cuffs on modern ski boots and avalement technique significantly increase the load resisting requirement of the toe hold down member to resist upward loading. Thirdly, there is an increased requirement for relatively rigid fixation of the ski boot on the ski to execute the precise turning maneuvers of modern ski technique. The toe piece construction as disclosed in U.S. Pat. No. 3,494,628 permits a relatively small load at the toe to pivot the upwardly extending member a slight distance such that there is excessive upward toe movement under normal skiing conditions. In the embodiments shown, the upwardly extending member must be pivoted rearwardly to an overcenter position to hold the boot toe to prevent the lower edge of the ski boot from abuting the member during normal skiing maneuvers with soft flex skiis. An additional requirement has developed with the use of this type of toe piece and the side clamping binding disclosed in U.S. Pat. No. 3,271,040. Presently, skiers prefer a releasable ski binding that is convenient to enter. With the side clamping binding, there is a tendency for the ski boot to slide to a forward position while stepping into the binding. With the toe piece construction as disclosed in U.S. Pat. No. 3,494,628, the toe piece is designed to be activated after the skier enters the binding. Also, a stop for the upstanding member to prevent the member from moving too far rearwardly overcenter or a stable centering device is not available at the toe on the ski in this disclosure to assist in centering the ski boot in the side clamping members.

U.S. Pat. No. 4,484,764 to Kirsch shows a toe piece which pivots forward during release. The toe piece engages a horizontal, that is parallel to the ski, surface on the ski boot toe. Many skiers will, at times, lean backwards while skiing. This backward lean tends to pivot the boot about the heel to cause the toe of the boot to push upward and slightly rearward on the toe piece. Because the interface of the boot toe against the toe piece of the Kirsch patent is parallel to the ski, the hold-down force between the toe piece and the boot toe may be overcome at the relatively low loads created during many skiing maneuvers. If this occurs the toe piece can pivot forward thus resulting in an unwanted release.

SUMMARY OF THE INVENTION

In view of the foregoing, a principal object of the present invention is an improved ski binding releasable toe piece that allows unimpeded forward movement of the ski boot along the ski upon ski binding release.

Another object of the present invention in accordance with the above object, is a releasable toe piece that requires that a greater force be applied to move the toe piece from the operative position holding the ski boot toe to the inoperative position upon ski binding release than is required for moving the toe piece from the inoperative to the operative position.

Another object of the present invention in accordance with the above objects is a toe piece having an upstanding holding member hinged to a baseplate, a resilient force member to pivot the upstanding holding member from the inoperative position to the operative position to hold the ski boot toe and a holding member engaging means that requires that a greater force be applied to the holding member to move the holding member from the operative position to the inoperative position upon ski binding release than from the inoperative position to the operative position.

BRIEF DESCRIPTION OF THE DRAWINGS

The above and other aspects, features and advantages of the present invention will become apparent from the following detailed description of the accompanying drawing in which.

DETAILED DESCRIPTION OF THE PREFERRED EMBODIMENTS

Figure 1:
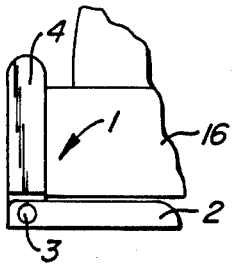
FIG. 1 is an elevational side view of the toe piece and a ski boot toe of the present invention with the holding member in the operative position.
Figure 2:
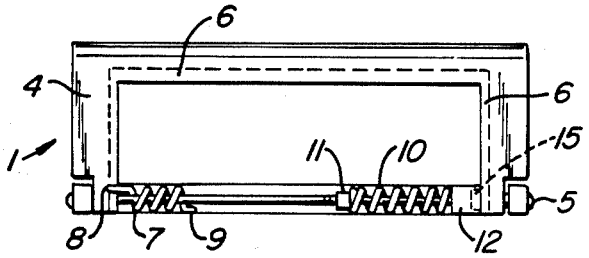
FIG. 2 is an elevational front view of the toe piece of FIG. 1.
Figure 3:
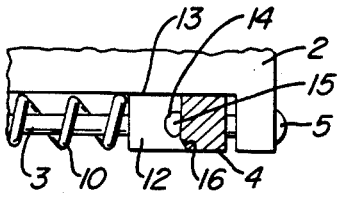
FIG. 3 is an enlarged partial top view of the toe piece.
Figure 4:
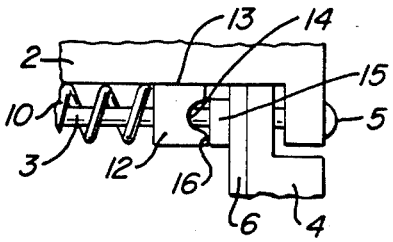
FIG. 4 is an enlarged partial top view of the toe piece with the holding member in an inoperative position.

Referring more particularly to the drawings, there is illustrated in FIGS. 1–4 a releasable toe piece 1 and ski boot toe 16. The toe piece 1 includes a baseplate 2 secured to a ski by screws or the like (not shown). Pivotably connected to the base plate 2 by a hinge pin 3 is an upright holding member 4. Holding member 4 is freely pivotable about hinge pin 3 generally transverse the longitudinal axis of the ski and is fixed in base plate 2 by hexigonal shape hinge pin heads 5. Holding member 4 has an inverted U shape and includes downwardly and forwardly inclined surfaces 6 that interface in nesting relationship with the toe 16 of the boot. The inclined surfaces can be designed to allow a predetermined sideward and upward movement of the ski boot toe without release from the holding member. Also, the lateral inclined surfaces can diverge toward the bottom of the holding member such that the lateral inclined surfaces contact only the upper outer edges of the ski boot toe. Since essentially all alpine ski boots are manufactured to standard ISO toe and heel dimensions, it is not necessary in most instances to provide an adjustable height and width device which is known per se for the holding member A torsion spring 7 is received and retained on hinge pin 3. One end of torsion spring 7 is secured in a slot 8 in holding member 4 and the other end of torsion spring 7 is secured in a slot 9 in base plate 2. Also, secured and retained on hinge pin 3 is a compression spring 10, an adjustment nut 11, which is threadably retained on hinge pin 3, and on the opposite end of compression spring 10, an engagement block 12. Block 12 is slidably retained on hinge pin 3 and includes a surface 13 that abuts the base plate 2 and prevents rotation of the block 12 relative to the base plate 2. Block 12 also includes a generally vertically oriented curved slot 14 that engages with a complementary curved rib 15 located on holding member 4 when holding member 4 is in an upstanding position, and an inclined ramp 16 that interfaces with rib 5 when the holding member 4 is pivoted forwardly against the ski.

In use, the holding member 4 is automatically pivoted to the upstanding position by the preset force of the torsion spring 7, and the adjustable preset force of the compression spring 10. In the upstanding position, the engagement of rib 15 in slot 14 prevents further backward rotation of the holding member 4 from the upstanding position and requires that a greater force be applied to the holding member to move the holding member forwardly from the operative position holding the ski boot toe to the inoperative position upon ski binding release than from the inoperative to the operative position. The skier enters the ski binding by engaging the toe of the ski boot with the inclined surfaces of the holding member. Then the skier moves the heel of the boot downwardly engaging the side clamping members or heel clamp of the particular ski binding. As the ski boot is released from the ski binding in a potential injury producing fall, the rib 15 is forced out of slot 14 by compression of spring 10 allowing the holding member 4 to pivot forwardly toward the ski. After release of the boot from the binding, the holding member 4 is automatically returned to the upstanding position.

Figure 5:
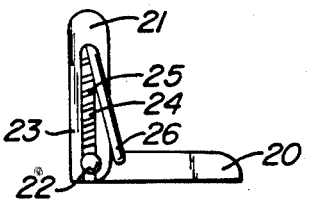
FIG. 5 is an elevational side view of an alternative embodiment of the present invention with the holding member in the operative position.
Figure 6:
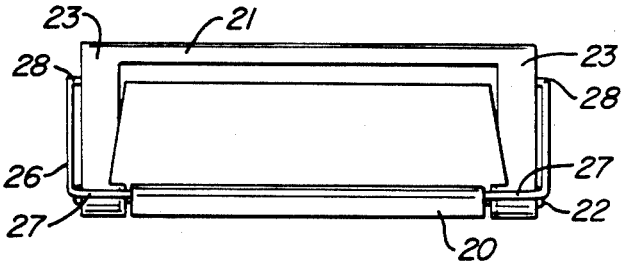
FIG. 6 is an elevational rear view of the toe piece of FIG. 5.
Figure 7:
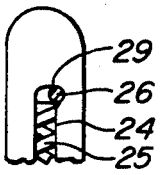
FIG. 7 is an enlarged partial side view of the holding member.

Referring to FIGS. 5–7, another embodiment of the releasable toe piece is shown. The toe piece includes a base plate 20 secured to a ski by screws or the like (not shown). An upstanding inverted U shaped holding member 21 is pivotably secured to the base plate 20 by a hinge pin 22. Integrated into each side of holding member 21 side arms 23 is an open sided bore 24 which retains a compression spring 25. The toe piece also includes a rod 26 on each side that has angulated segments 27 and 28 that are engaged in base plate 20 and bore 24 respectively. Bore 24 includes a slot 29 for engaging the rod 26 when the holding member 21 is in the operative position. The compression spring 25 is retained between the side walls of the bore 24, the angulated segment 28 of the rod 26 and the hinge pin 22.

With a side clamping type ski binding, a stabilizing member only is necessary at the toe of the boot so that an adjustment feature is not necessary since the retention and release ratios are designed into the side clamping members.

In use, the holding member 21 is pivoted to the upstanding position by the force of the compression springs 25 moving the angulated segments 28 of the rods 26 upwardly into slots 29. This engagement in slots 29 prevents further backward rotation of holding member 21 from the upstanding position and requires that a substantially greater force be applied to move the holding member forwardly from the operative position holding the ski boot toe to the inoperative position upon ski binding release than from the inoperative to the operative position. In release of the ski boot from the holding member, the angulated segments 28 of rods 26 are forced out of slots 29 and compress springs 25 as the holding member is pivoted forwardly toward the surface of the ski. After release of the boot from the binding, the holding member 21 is automatically returned to the upstanding position.

Figure 8:
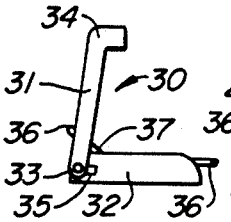
FIG. 8 is an elevational side view of an alternative embodiment of the present invention with the holding member in the operative position.
Figure 9:
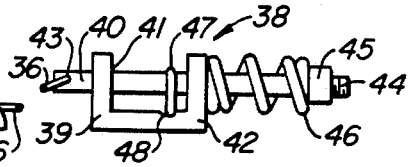
FIG. 9 is an elevational side view of a tensioning device in the operative position.

Referring to FIGS. 8–9 in still another embodiment of a releaseable toe piece 30, an upstanding holding member 31 is pivotably secured to a base plate 32 by a hinge pin 33. Holding member 31 includes a curved hold down lip 34 that retains the toe of a ski boot against forward, upward and sideward movement. The holding member 31 also includes a stop 35 that prevents further backward rotation of the holding member 31 from the upstanding position. A cable 36 is attached to the holding member 31 above the pivot axis and passes through a slot 37 in the baseplate 32 to a remote tensioning device 38. Tensioning device 38 includes a U shaped bracket 39 secured to a ski by screws or the like (not shown). A rod 40 is slidably engaged in slots 41 in upright members 42 in bracket 39. Rod 40 includes a bore 43 that receives the cable 36 passing from the holding member 31 and a threaded section 44 that receives an adjustment nut 45. Also, a compression spring 46 is received and retained on rod 40 between the bracket 39 upright member 42 and adjustment nut 45. A downwardly extending tab 47 secured to the rod 40 engages a curved notch 48 in the bracket 39 when the toe piece upstanding holding member 31 is in the upstanding position.

In use, the holding member 31 is automatically pivoted to the upstanding position by the adjustable preset force of compression spring 46. The engagement of downwardly extending tab 47 with notch 48 increases the amount of force necessary to move the upstanding holding member 31 from the operative to the inoperative position than from the inoperative to the operative position. Also, the shape and size of the interfacing surfaces of the tab 47 and notch 48 determines the amount of movement possible at the toe of the boot without release of the toe from the toe piece.

Figure 10:
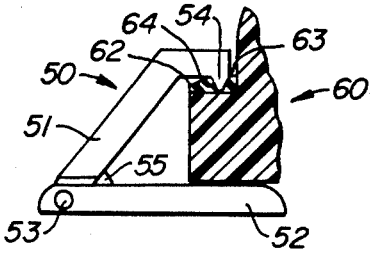
FIG. 10 is an elevational side view of an alternative embodiment of the present inventions with the holding member in the operative position.
Figure 11:
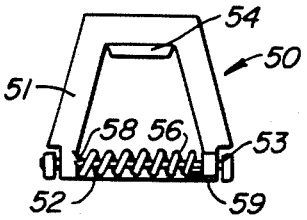
FIG. 11 is an elevational front view of the toe piece of FIG. 10.
Figure 12:
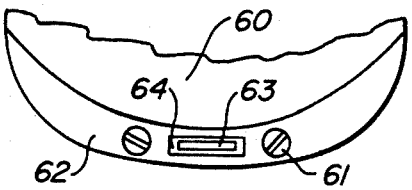
FIG. 12 is an enlarged partial top view of the ski boot toe.

Referring to FIGS. 10–12 in another embodiment of a releasable toe piece 50, an upstanding holding member 51 is pivotably secured to a baseplate 52 by a hinge pin 53. Baseplate 52 is secured to the ski by screws or the like (not shown). Holding member 51 includes a wedge shaped hold down lip 54 that retains the toe of a ski boot 60 against forward, upward and sideward movement. The baseplate 52 includes a stop 55 that prevents further backward motion of the holding member 51 from the upstanding position. A preset loaded torsion spring 56 is received and retained on hinge pin 53 and automatically pivots upholding member 51 to the operative position. One end of torsion spring 56 is secured in a slot 58 in baseplate 52. The other end of torsion spring 56 is secured in a slot 59 in upholding member 51. Integrated into or secured to the ski boot toe 60 by screws 61 or the like is a plate 62 that includes a notch or recess 63 with side walls 64 that are complementary in shape to the wedge shaped hold down lip 54 of holding member 51. The notch may be located in the hold down lip 54 and the wedge shaped member may be located in the ski boot toe 60.

In use, the holding member 51 is pivoted to the upstanding position by the force of the torsion spring 56 moving the wedge shaped hold down lip 54 into engagement with the complementary shaped notch 63 in plate 62. This engagement requires that a greater force be applied to move the holding member forwardly from the operative position holding the ski boot toe to the inoperative position upon ski binding release than from the inoperative to the operative position. In release of the ski boot toe from the holding member, the hold down lip 54 is forced out of notch 63 as the hold down member is pivoted forwardly toward the surface of the ski. The configuration of complementary shaped hold down lip 54 and notch 63 determines the amount of movement possible at the toe of the ski boot before release of the toe from the toe piece. After release of the ski boot toe from the toe piece the holding member is automatically returned to the upstanding position.

The forwardmost sidewall 64 of plate 62 angles down and to the rear relative to the ski. This configuration helps to ensure that holding member 51 does not inadvertently release during normal skiing manuevers. That is, during normal skiing the user may lean back in the ski boots which tends to cause the toe of the boot to pivot upwardly and rearwardly as it tries to pivot around the heel. The orientation of the forwardmost sidewall 64 of notch 63 (down and to the rear) helps to prevent inadvertent release during such conditions.

In the embodiment of FIGS. 10–12 a wedge-shaped hold-down lip 64 and recess 63 are used. Sidewalls 64 could be arcuate instead of flat if desired. Only recess 63 need have the downwardly and rearwardly angled surface. Also, the embodiment of FIGS. 10–12 could include a detent, such as shown in the other figures, as well.

While an embodiment and suggested alternative features are described, it is understood that various other modifications and changes may be made without departing from the spirit and scope of the present invention. Accordingly, it is intended that the scope of the present invention not be limited to the embodiment described but be determined by reference to the claims hereinafter appended and their equivalents.

What is claimed is:

1. In combination with a ski and a ski boot having a ski boot toe portion, a ski binding releasable toe piece comprising:

a base plate mounted to the ski;

an upstanding holding member pivotally mounted to the base plate for movement about a transverse axis between a rearward, ski boot toe engaging position and a forward, inoperative position generally adjacent to the top surface of the ski;

means for biasing the holding member towards the ski boot toe engaging position;

a stop, coupled to the baseplate, for limiting the rearward pivotal movement of the holding member; and a chosen one of the ski boot toe portion and the holding member including a wedge-shaped hold down lip, the other of the ski boot toe portion and the holding member including a wedge-shaped recess shaped for complementary engagement with the hold down lip, wherein the holding member retains the ski boot toe against movement in directions parallel to and transverse to the ski axis.

2. The toe piece of claim 1 wherein the biasing means includes a spring.

* * * * *